US008028833B1

(12) United States Patent
Clark

(10) Patent No.: US 8,028,833 B1
(45) Date of Patent: Oct. 4, 2011

(54) CONTAINER FOR LIPSTICKS, ALLOWING QUICK COLOR IDENTIFICATION

(76) Inventor: Patricia G. Clark, Nashville, TN (US)

( * ) Notice: Subject to any disclaimer, the term of this patent is extended or adjusted under 35 U.S.C. 154(b) by 0 days.

(21) Appl. No.: 12/589,428

(22) Filed: Oct. 23, 2009

Related U.S. Application Data

(60) Provisional application No. 61/197,476, filed on Oct. 27, 2008.

(51) Int. Cl.
*B65D 85/72* (2006.01)

(52) U.S. Cl. ..... 206/385; 206/581

(58) Field of Classification Search ..... 220/495; 383/42, 38, 210; 206/385
See application file for complete search history.

(56) References Cited

U.S. PATENT DOCUMENTS

| | | | | |
|---|---|---|---|---|
| 3,181,751 | A * | 5/1965 | Wilson | 383/39 |
| 3,575,327 | A * | 4/1971 | Harrison | 294/149 |
| 4,610,348 | A | 9/1986 | Dailey | |
| 4,715,499 | A * | 12/1987 | Franklin | 206/373 |
| 5,327,669 | A * | 7/1994 | Lannan et al. | 43/26 |
| 5,361,603 | A | 11/1994 | Merritt-Munson | |
| 6,070,729 | A * | 6/2000 | Barnes | 206/581 |
| 6,554,001 | B1 | 4/2003 | Godshaw | |
| 6,733,095 | B1 * | 5/2004 | Rieb | 312/122 |
| 7,021,318 | B2 | 4/2006 | Byun | |
| 7,591,382 | B2 | 9/2009 | Brock | |
| 2004/0222125 | A1 * | 11/2004 | Meing | 206/581 |
| 2004/0232035 | A1 * | 11/2004 | Hume et al. | 206/581 |

* cited by examiner

*Primary Examiner* — J. Gregory Pickett
*Assistant Examiner* — Raven Collins

(57) ABSTRACT

A container for lipsticks able to hold several lipsticks and other utensils in the cosmetics line and having a pliable base material (16) with a pliable top material lying flat (10) against the pliable base material in some areas and in other areas forming pockets (14) that lie in vertical columns. The pockets (14) of one column are offset from the pockets (14) of the other column so that when folded vertically the pockets of one column lie between the pockets of the other column. In addition, having double layers of a flexible transparent material (12) for identifying the color of each lipstick, a device to keep the upper edge rigid (18) while allowing it to be folded vertically and a closure and or hanging device (20). Because all the pockets open toward the center of the pliable base material, none of the contents can be spilled from the pockets when the container for lipsticks is folded vertically, rolled and secured with the closure device (20). When open flat all the lipstick colors can be seen at once.

3 Claims, 2 Drawing Sheets

CONTAINER FOR LIPSTICKS, ALLOWING QUICK COLOR IDENTIFICATION

CROSS REFERENCE TO RELATED PROVISIONAL PATENT

This application claims the benefit of my earlier filed provisional patent App. No. 61/197,476 issued Oct. 27, 2008.

BACKGROUND OF INVENTION

1. Field of Invention

This invention relates to cosmetic storage containers, specifically to containers for lipsticks.

2. Prior Art

Cosmetic storage containers for lipsticks now in use take up much space. They aren't easily transported. Reading the small print labels or opening the tubes to see the color is the only way to identify the exact color of identical tubes of lipstick. Most current storage containers are either bags, which do not provide order, or rigid units, which are not easily cleaned or transported. The contents of current storage containers can spill or become disorganized when transported.

OBJECTS AND ADVANTAGES

Several objects of the present invention are:

A. To provide a storage container for multiple tubes of lipstick

B. To provide more than one way of storing the container for lipsticks

B. To provide a method of identifying the color of a lipstick without reading the small print label or opening the tube C. To provide storage for additional cosmetics and or related materials along with lipsticks D. To provide a cosmetic storage container for lipsticks that is easily cleaned.

E. To provide a cosmetic storage container that is easily transported

F. To provide a container that allows all the colors of the lipsticks therein to be seen at once Further objects and advantages are to provide a container for lipsticks that provides order, that is easy to use and manufacture, that is portable and easily stored. Also, to provide a container that allows all the colors of the lipsticks therein to be seen at once. Still further objects and advantages will become apparent from a consideration of the ensuing description and drawings.

SUMMARY

In accordance with the present invention a container for lipsticks comprises a pliable base material with a second pliable material attached to form pockets aligned in vertical columns. The pockets of one column being off set from the pockets of the other column so that when the container is folded vertically the pockets of one column lie between the pockets of the other column. There are double layers of a flexible transparent material attached to each pocket to be, marked between the layers with the color of the lipstick contained in that pocket. There is a device at the top edge to keep the top edge, and thus the container, flat and allow it to be folded vertically. To be stored or transported the container is folded vertically, rolled and secured. With the openings of the pockets facing the center of the container there is no possibility of the contents of the pockets being spilled when the container is folded, rolled and closed for transport. There is a device to keep the container closed. This device can also be used to hang the container flat on a hook or clothes hanger.

DRAWINGS

Figures

DRAWINGS

Reference Numerals

Figure 1:
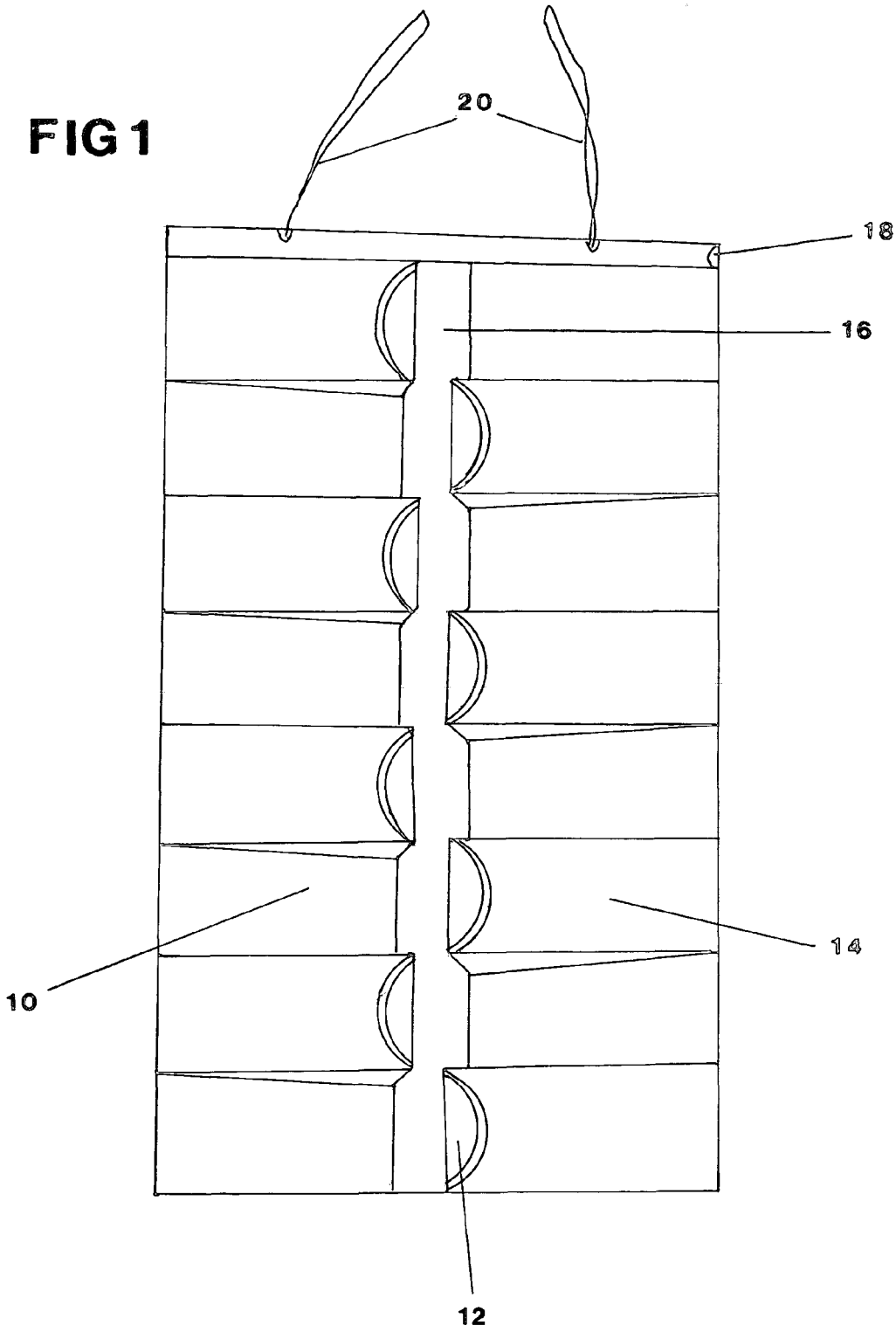
FIG. 1 Shows the front of a container for lipsticks with pockets in two vertical columns, one column's pockets offset from the other column, and with pocket openings facing the center fold line.

10 Pliable top material lying flat against pliable base material

12 Double layers of a flexible transparent material for identifying lipstick colors

14 Pliable top material forming a pocket

16 Pliable base material

18 Device to keep upper edge rigid while allowing it to be vertically folded

20 Closure device and/or hanging device

DETAILED DESCRIPTION FIGS. 1-3

Figure 2:
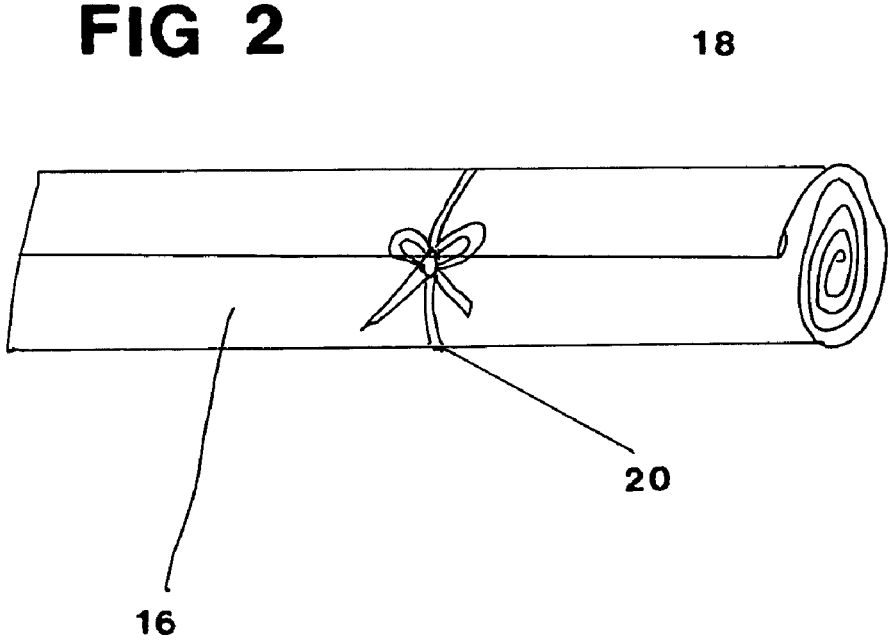
FIG. 2 Shows a container for lipsticks that has been folded vertically, rolled and secured for storage or transport.
Figure 3:
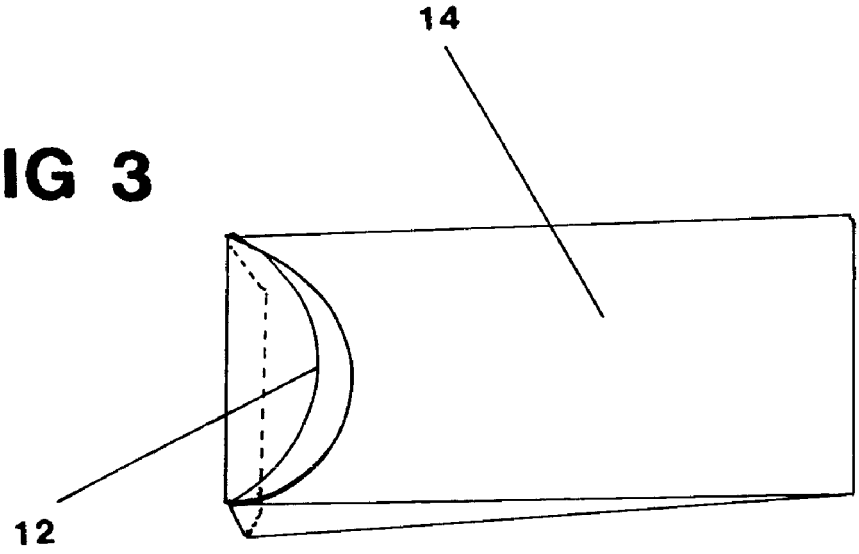
FIG. 3 Shows a close view of one pocket with double layers of a flexible transparent material attached for lipstick color identification.

A preferred embodiment of the container for lipsticks of the present invention is illustrated in FIG. 1 (front), FIG. 2 (closed and secured) and FIG. 3 (individual pocket). The container for lipsticks has a pliable base material (16) with a pliable top material attached at intervals to form offset pockets (14) in two vertical columns and lie flat between pockets (10). To each pocket a double layer of flexible transparent material (12) is attached. There is a device (18) for keeping the upper edge rigid while allowing it to be vertically folded and a device for closure and or hanging (20). The pockets are aligned in vertical columns with the pockets in each column offset so that the pockets of one column will lie between the pockets of the other column when the container is folded vertically. The openings of the pockets are to the center of the base material. After folding vertically the container is rolled and secured for storage with the closure and/or hanging device (20). When in use the container is hung flat exposing all pockets and showing the colors of all lipsticks at a glance. When closed the contents of the pockets cannot be spilled or become disorganized.

Operation FIGS. 1-3

The manner of using the container for lipsticks is to mark the color of a lipstick between the double layers of flexible transparent material (12) that is attached to each pocket (14). The lipstick tube is then placed in the pocket (14) thus allowing the color of that lipstick to be identified without opening the tube or reading the small print on the label. This procedure is followed for all the pockets. Other cosmetics and related implements (a fingernail file, cosmetics brushes, eyeliners, etc.) can be placed in the flat sections (10) between pockets (14). The container is then hung by the closure/and or hanging device (20) on a hook or clothes hanger. The device to keep the upper edge rigid (18) and still allow it to be folded vertically will keep the container for lipsticks flat when hung. When hung flat all the lipsticks' colors can be viewed at once. When not in use the container can be folded vertically with the pockets of one column lying between the pockets of the other column. All the pocket openings face the center of the base material so that when folded the contents of the pockets remain in the pockets. After folding the container is rolled and secured with the closure device (20) as in FIG. 2. In this way the container can be stored or transported without fear of spilling the contents or causing disarray.

ALTERNATIVE EMBODIMENTS

There are various possibilities with regard to the materials that are used. The material used can dictate the way in which the cosmetic container can be closed. There may be a need for separate devices to close and to hang. The transparent material can take a variety of shapes.

ADVANTAGES

From the description above a number of advantages of this cosmetic container become evident:

(a) This cosmetic container is easy to transport and store.

(b) The color of a lipstick is easily identified.

(c) This cosmetic container offers convenient methods of display.

(d) While primarily for storing lipstick, other cosmetics and accessories can be stored in this container.

(e) This cosmetic container can be made in various materials and colors.

(f) The colors of all lipsticks contained can be seen at once.

(g) When folded and rolled the contents in the pockets will stay in the pockets

CONCLUSIONS, RAMIFICATIONS AND SCOPE

Accordingly, the reader will see that this container for lipsticks is easily transported. It can be stored in a relatively small space. When it is open and hanging flat, all the colors of the lipsticks in it can be viewed at once. When folded and rolled for storage or transport the contents of the pockets cannot spill out. It can be manufactured in a variety of sizes and colors and in a variety of materials.

Thus the scope of the invention is wide and not limited to the example given.

The invention claimed is:

1. A lipstick container comprising a flexible top material attached at equal intervals to a flexible base material thereby forming a plurality of pockets lying horizontally in vertical columns with each said pocket comprising a closed base and an opening that opens toward a center of the said flexible base material, the pockets of one vertical column being offset from the pockets of the opposite said column, wherein an additional double layer of separable, flexible transparent material is attached to each said pocket at the opening whereby lipstick may be placed between each said double layer of separable, flexible transparent material such that the color of lipstick contained in each said pocket may be marked by a user, and a device for closing and/or hanging, wherein when folded vertically the said pockets of one said column lie between the said pocket of the other said column, wherein after folding vertically the said lipstick container can be rolled and secured with said closing device for storage or transportation and the contents will not spill from the pockets, and wherein when hung open flat, all the said pockets can be viewed at once and all contents of said pockets can be identified by color at once.

2. The cosmetic container of claim 1 containing a device for making the top edge rigid while allowing it to be folded.

3. The cosmetic container of claim 1 containing a device for hanging said container.

* * * * *